US007107730B2

(12) United States Patent
Park

(10) Patent No.: US 7,107,730 B2
(45) Date of Patent: Sep. 19, 2006

(54) PSSC COMPLEX GIRDER

(76) Inventor: Jae-Man Park, 155-1, Neungwon-Ri, Mohyeon-Myeon, Yongin, Gyeonggi-Do (KR)

( * ) Notice: Subject to any disclaimer, the term of this patent is extended or adjusted under 35 U.S.C. 154(b) by 347 days.

(21) Appl. No.: 10/233,472

(22) Filed: Sep. 4, 2002

(65) Prior Publication Data

US 2004/0040233 A1 Mar. 4, 2004

(51) Int. Cl.
*E04C 5/08* (2006.01)

(52) U.S. Cl. ..... 52/223.8; 52/223.14; 52/732.1

(58) Field of Classification Search ..... 52/223.8, 52/223.11, 721.3, 721.4, 723, 724, 725, 729.1, 52/223.9, 223.12, 223.13, 223.14, 732.1
See application file for complete search history.

(56) References Cited

U.S. PATENT DOCUMENTS 515,963 A * 3/1894 Krause ..... 52/737.4
542,283 A * 7/1895 Rousseau ..... 52/729.2
916,378 A * 3/1909 Sunderland ..... 52/254
918,643 A * 4/1909 Aylett et al. ..... 52/724.1
930,611 A * 8/1909 Pelton ..... 52/344
963,734 A * 7/1910 Morrill ..... 264/112
1,572,669 A * 2/1926 Muller ..... 52/721.2
1,714,949 A * 5/1929 Collier et al. ..... 405/253
2,020,407 A * 11/1935 Forster ..... 52/649.7
2,844,023 A * 7/1958 Maiwurm ..... 52/223.8
3,110,049 A * 11/1963 Nagin ..... 14/73
3,302,348 A * 2/1967 Pratt ..... 52/223.8
3,368,016 A * 2/1968 Birguer ..... 264/228
3,440,793 A * 4/1969 Zehnle ..... 52/724.1
3,487,518 A * 1/1970 Hopfeld ..... 29/897.35
3,516,213 A * 6/1970 Sauer ..... 52/721.4
3,577,504 A * 5/1971 Lipski ..... 264/255
3,798,867 A * 3/1974 Starling ..... 52/721.4
3,813,834 A * 6/1974 Davis, Jr. ..... 52/223.8
3,837,131 A * 9/1974 Bisschops et al. ..... 52/577
4,018,055 A * 4/1977 Le Clercq ..... 405/257
4,125,973 A * 11/1978 Lendrihas ..... 249/188
4,196,558 A * 4/1980 Jungbluth ..... 52/724.1
4,407,106 A * 10/1983 Beck ..... 52/721.3
4,571,913 A * 2/1986 Schleich et al. ..... 52/724.1
4,616,464 A * 10/1986 Schleich et al. ..... 52/721.4
4,628,654 A * 12/1986 Boswel ..... 52/319
4,646,493 A * 3/1987 Grossman ..... 52/223.1
4,722,156 A * 2/1988 Sato ..... 52/98
4,779,395 A * 10/1988 Schleich et al. ..... 52/721.3
4,783,940 A * 11/1988 Sato et al. ..... 52/223.4
5,119,614 A * 6/1992 Rex ..... 52/721.2
5,152,112 A * 10/1992 Eustace ..... 52/223.8
5,279,093 A * 1/1994 Mead ..... 52/724.5
5,410,847 A * 5/1995 Okawa et al. ..... 52/272
5,507,522 A * 4/1996 Ritchie ..... 280/800
5,511,355 A * 4/1996 Dingler ..... 52/729.5

(Continued)

*Primary Examiner*—Naoko Slack

(57) ABSTRACT

A PSSC complex girder in which a section shape steel structure is formed by joining one or more section shape steel. The PSSC complex girder includes a tension means for tensioning the section shape steel structure with a tensional member so that the structure has a predetermined camber. Concrete is poured in an inner space portion of the section shape steel structure. A strengthening plate for supporting buckling and compression is joined to the section shape steel. A sheer prevention member and steel reinforcement are joined to the section shape steel and the concrete is poured therein. The camber of the PSSC complex girder can be adjusted before or after construction for new bridges and conventional bridges. Deflection of the slab can be easily decreased and cracks caused by flexural deformation can be prevented.

1 Claim, 13 Drawing Sheets

U.S. PATENT DOCUMENTS 5,560,176 A * 10/1996 Levo ..... 52/724.1
5,644,890 A * 7/1997 Koo ..... 52/742.14
5,680,738 A * 10/1997 Allen et al. ..... 52/729.1
5,848,512 A * 12/1998 Conn ..... 52/729.1
5,852,905 A * 12/1998 Collina et al. ..... 52/223.8
6,061,992 A * 5/2000 Vincent ..... 52/721.3
6,318,038 B1 * 11/2001 Park ..... 52/223.13
6,332,301 B1 * 12/2001 Goldzak ..... 52/729.2
6,341,456 B1 * 1/2002 Majnaric et al. ..... 52/724.1
6,384,610 B1 * 5/2002 Wilson ..... 324/663

* cited by examiner

PSSC COMPLEX GIRDER

BACKGROUND OF THE INVENTION

1. Field of the Invention

The present invention relates to a pre-stressed steel and concrete (PSSC) complex girder and particularly, to a PSSC complex girder which can achieve all of the advantages of both a pre-stressed concrete (PSC) girder and a steel girder. The PSSC complex girder can be made by forming a section shape steel structure by joining one or more section shape steel, such as an I-section shape steel or an H-section shape steel disposed either vertically or in parallel. A tensional member is added to compensate for deflection by applying a pre-stress to the section shape steel structure. Concrete is poured into an inner space portion of the section shape steel structure in a predetermined shape.

2. Description of the Background Art

Generally, a pre-stressed concrete beam (hereinafter, a PSC beam) adds tension to a tensional member using hydraulic equipment, after the tensional member is laid inside of a steel reinforcement concrete beam. Both ends of the tensional member extend outside both ends of the beam, and offset tensile stress occurring in a steel reinforcement concrete beam by operating compression having an eccentric distance along the symmetric axis from both ends of the beam.

The tensioning method is divided into a pre-tension method and post-tension method, in accordance with the settling method of the tensional member.

By operation of the tensional member, tensile stress either does not occur, or a very small amount of tensile stress occurs on a lower surface of the PSC beam, which prevents cracks from occurring in the beam. Even if tensile stress occurs on the lower surface of the beam, no cracks occur if the tensile stress is less than the flexural tensile strength. This kind of PSC beam is more variously applied to civil engineering structures, including bridges, than is reinforced concrete (RC).

For example, a bridge having short and medium spans is usually constructed with a PSC beam, while a bridge having long spans is usually constructed with steel materials, but can also be constructed with the PSC beam. In terms of buildings, the PSC beam is used for a built-up structure, which requires a large space.

In the conventional PSC beam, however, there are limitations to a long span and durability because there has been little change in the basic structure of the beam, while there have been changes in settlement devices and hydraulic equipment.

On the other hand, when the strength of a conventional bridge, constructed by girders, is degraded, the chosen construction method for repairing and strengthening the PSC beam with hydraulic equipment, is to fix brackets to both ends of the PSC beam, and fix both ends of tensional member to the brackets with a settlement member.

Such a construction method, however, has problems in management, for example, because the conventional bridge is reinforced when the strength of the bridge is degraded.

In addition, the conventional construction method has disadvantages including corrosion occurring on the lower surface, and the span length becoming shortened because tensile cracks in the concrete occur in the lower flange as a result of partial prestressing.

SUMMARY OF THE INVENTION

Therefore, an embodiment of the present invention provides a PSSC complex girder, which can have a longer span than a PSC beam and improved durability. The PSSC complex girder is a section shape steel structure formed by joining one or more section shape steel, such as I-section shape steel or H-section shape steel either vertically or in parallel, joining a tensional member that compensates for deflection by applying a pre-stress to the section shape steel structure, and pouring concrete in an inner space portion of the section shape steel structure in a predetermined shape.

To achieve these and other advantages and in accordance with the present invention, as embodied and broadly described herein, PSSC complex girder, includes a section shape steel structure formed by joining one or more section shape steel, a tension means for tensioning the section shape steel structure using the tensional member, so that the structure has a predetermined camber. Concrete is placed in the inner space portion of the section shape steel structure.

The section shape steel structure, is formed in a box shape by overlapping and welding a section shape. Alternatively, or a pair of side members can be welded together by overlapping the section shape steel vertically and horizontally. Various types of section shape steel can be joined.

In the embodiment of the present invention, a box-type section shape steel structure can be formed by welding a pair of section shape steel side members to each other or by welding both side members to each other and using bolts to connect each section shape steel structure.

A settlement fixing plate is fixed at both end portions of the section shape steel structure by a strengthening plate. Both end portions of the tensional member are fixed in a settlement member and inserted through holes in the settlement fixing plates to extend to an outer portion of the settlement fixing plates. Inside each section shape steel, are strengthening plates for preventing buckling among the web and the upper and lower flanges. A plurality of sheer prevention members are disposed inside of the web, and steel reinforcement is arranged in the inner space portion of each steel girder. Concrete is poured around the steel reinforcement.

The tensional member includes, for example, a steel strand inserted in a sheath pipe, and a conventional hydraulic jack can be used to add tension to the tensional member. In addition, concrete can be poured into in the inner space portion of the section shape steel structure or can be poured into part of the section shape steel structure.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIGS. 1 to 5B show a complex girder in accordance with the first embodiment of the present invention:

FIG. 1 is an unfolded perspective view showing the complex girder;

FIG. 2 is a partial plan view showing the complex girder;

FIG. 3 is a partially-sectional side view showing the complex girder;

FIG. 4 is a partial front view showing the complex girder; and

FIGS. 5A and 5B are partially-sectional perspective views showing a changed shape of the complex girder by applying pre-stress to the complex girder to have camber, FIGS. 6 to 9B show a complex girder in accordance with the second embodiment of the present invention:

FIG. 6 is an unfolded perspective view showing the complex girder;

FIG. 7 is a partial plan view showing the complex girder;

FIG. 8 is a partially-sectional perspective view showing the complex girder; and FIGS. 9A and 9B are partially-sectional perspective views showing a cambered shape of the complex girder by pre-stressing.

DETAILED DESCRIPTION OF THE PREFERRED EMBODIMENTS

Reference will now be made in detail to the preferred embodiments of the present invention, examples of which are illustrated in the accompanying drawings.

Figure 1:
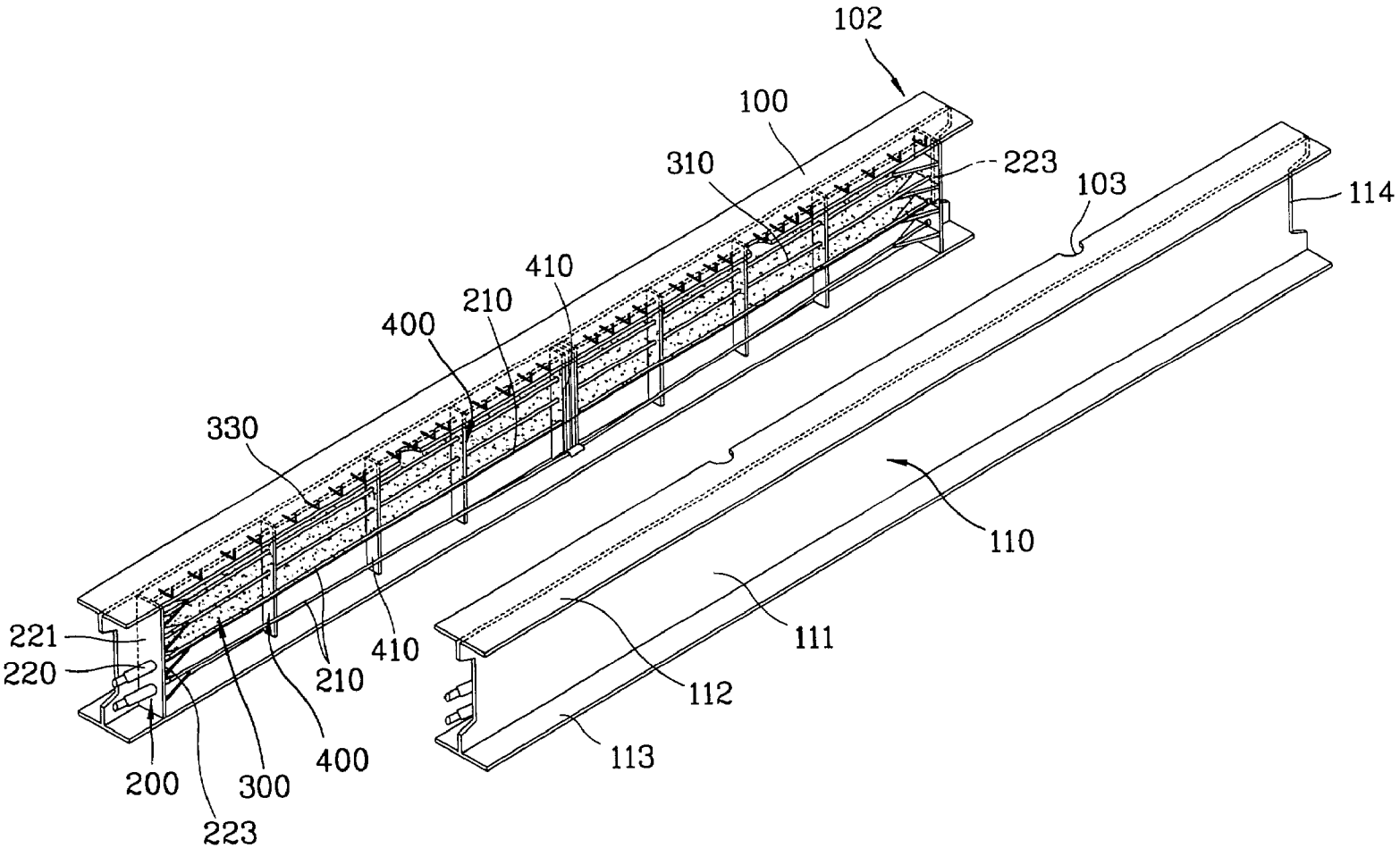
Figure 2:
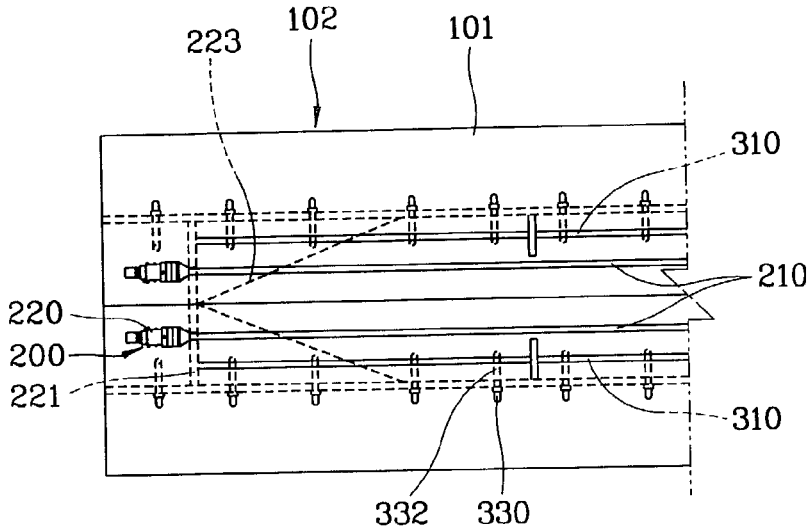
Figure 3:
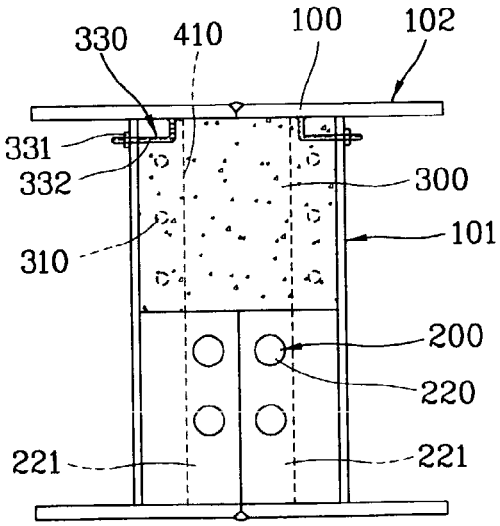
Figure 4:
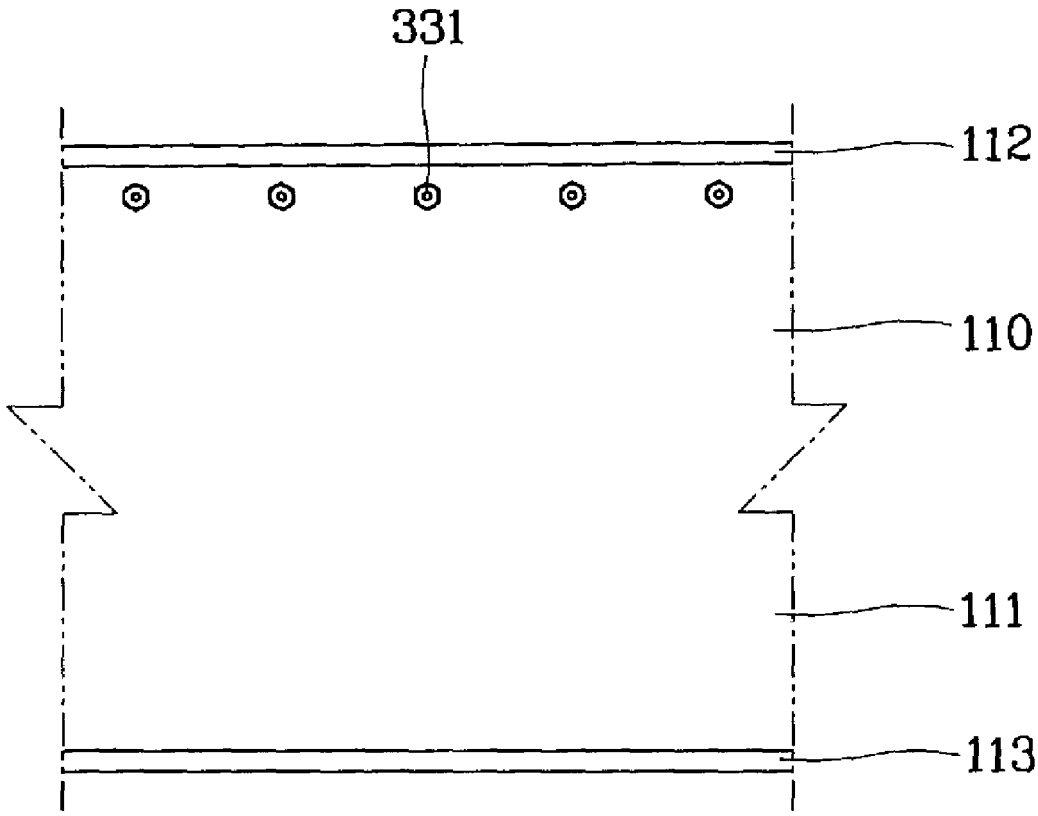
Figure 5A:
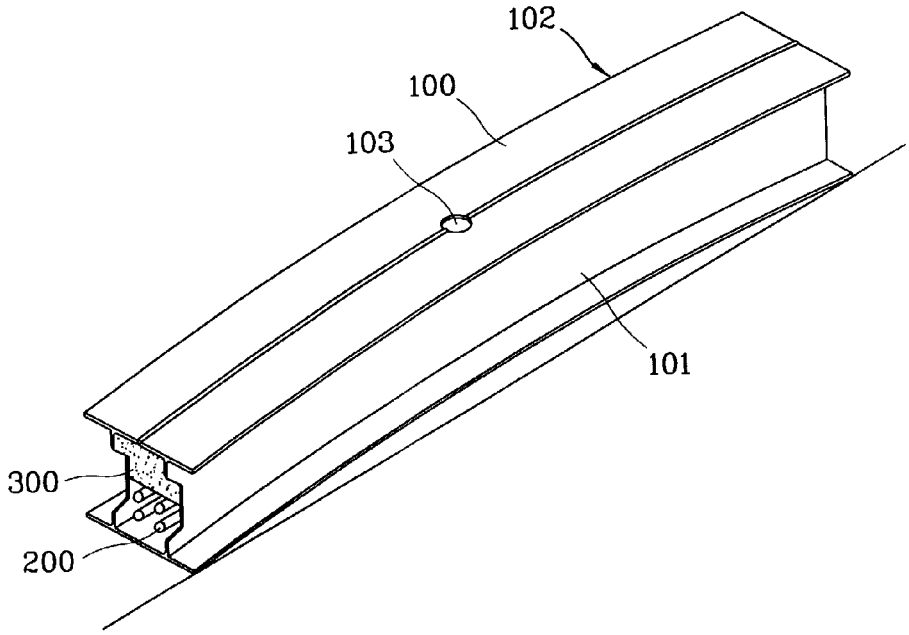
Figure 5B:
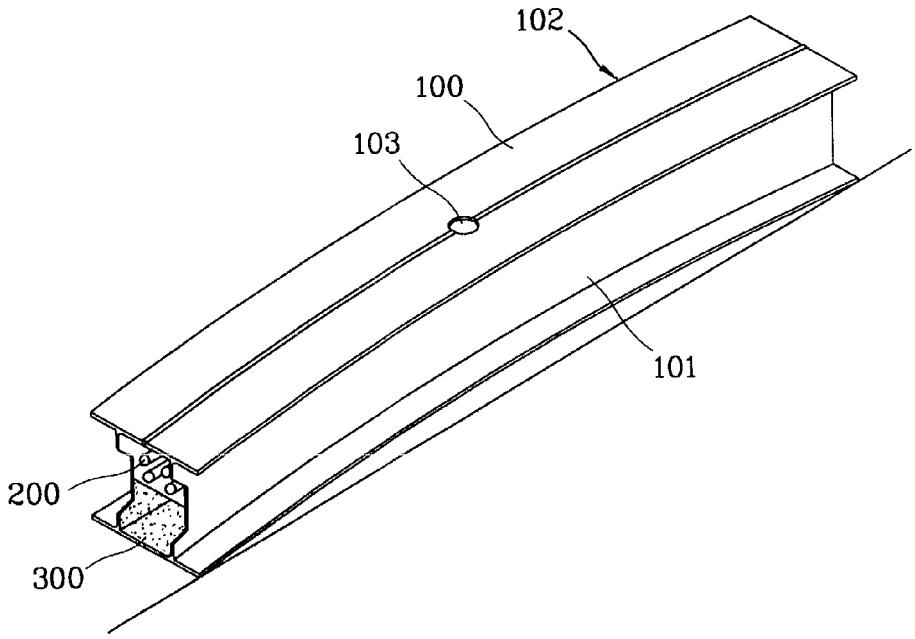

FIGS. 1 to 5B show a complex girder in accordance with the first embodiment of the present invention. FIG. 1 is an unfolded perspective view showing a complex girder. FIG. 2 is a partial plan view showing the complex girder. FIG. 3 is a partially-sectional side view showing the complex girder. FIG. 4 is a partial front view showing the complex girder. FIGS. 5A and 5B are partially-sectional perspective views showing a changed shape of the complex girder by applying pre-stress to the complex girder to have camber.

As shown in the drawings, tension means 200 mounts both end portions of a tensional member 210 in the section shape steel structure 102. The section shape steel structure 102 is made of section shape steel 100, such as an I-section shape steel or an H-section shape steel. Tensioned end portions of the tensional members 210, are joined to the section shapes steel to form the PSSC complex girder in accordance with the present invention. Concrete 300 is poured into the inner space of the section shape steel structure 102 to form a girder body that is tensioned by the tension means 200 resulting in a camber of the girder body.

A section shape steel assembly 101, which is formed by welding both sides of the section shape steel 100, can be used to form the section shape steel structure 102.

The tension means 200 includes settlement fixing plates 221 respectively fixed to both end portions of the inner surface of each section shape steel 100, which forms the section shape steel structure 102.

Both end portions of the tensional members 210 are inserted into the settlement member 220 and pass through holes, formed in a row in the settlement fixing plates 221. The tensional member 210 is fixed in two rows, for example, at both end portions of the section shape steel assembly 101 as shown in FIG. 1.

Inside each section shape steel 100, strengthening means 400, for preventing buckling, are respectively disposed between a web 111 of the section shape steel 100 and upper and lower flanges 112 and 113. A plurality of sheer prevention members 330 is also joined to the inside of the web 111. Steel reinforcements 310 are arranged in the inner space of both the section shape steel 100 and the concrete 300 is poured therein.

Strengthening means 400 include, a plurality of strengthening plates 410 welded to the upper and lower flanges 112 and 113 inside the section shape steel 100 at predetermined intervals in the web 111. The steel reinforcements 310 are inserted in a plurality of holes formed in the strengthening plates 410. The plurality of sheer prevention members 330 are inserted into through holes formed in the upper end portion of the web 111 of the respective section shape steel 100. A nut 331 is welded to the outer portion of the web 111 and secures an anchorage bolt 332, which is bent into an 'L' shape.

Strengthening plates 223 for strengthening the section shape steel 100 are fixed to the inside of the settlement fixing plate 221 which is fixed to both end of both the section shape steel 100. Grooves 114 are formed at both ends of the web 111 so that tensile devices, such as hydraulic equipment can be easily installed, if necessary.

In manufacturing the PSSC complex girder in accordance with the present invention, a plurality of strengthening plates 410 are welded to the inside of the web portion 111 of the section shape steel 100, such as an I-section shape steel or an H-section shape steel cut in a predetermined length.

A plurality of sheets (for example, three sheets) of strengthening plate 410 is welded to a center portion of the web 111. Nuts 331 secure the sheer prevention members 330 in the plurality of holes formed at the upper end portion of the web 111 and are welded to the outer portion of the web 111.

Anchorage bolts 332 forming the sheer prevention members 330 are joined with the respective nuts 331. Steel reinforcements 310 are inserted through a plurality of holes formed in the strengthening plates 410.

The settlement fixing plate 221 and strengthening plate 223 are welded to both end portions of the web 111. Both end portions of the tensional members 210 extend to the outer portion of the web 111 through holes which are formed in both the settlement fixing plate 221, and a settlement member 220.

As described above, after manufacturing a steel-frame structure which is mainly made of the section shape steel 100 and installing the tension means 200, the sections are joined by V-cut welding the section shape steel 100.

Then, pre-stress is applied by using tensile devices, such as hydraulic equipment and tensioning the tensional member 210 to a first predetermined degree.

Then, concrete 300 is poured into the injection hole 103 which is formed in the upper flange 112 of both the section shape steel 100 and cured. See FIG. 5A.

When the concrete 300 is cured, pre-stress is again applied by tensioning the tensional member 210 to a second predetermined degree.

With the above processes, as shown in FIGS. 5A and 5B, a PSSC complex girder can obtain a curved shape having a predetermined camber (elevation). The tensioning process for tensioning the tensional member 210 can be performed by adjusting the tension. After the manufacturer of the PSSC complex girder, for example, the amount of tension can be randomly adjusted, as needed, for constructing and repairing bridges.

Figure 6:
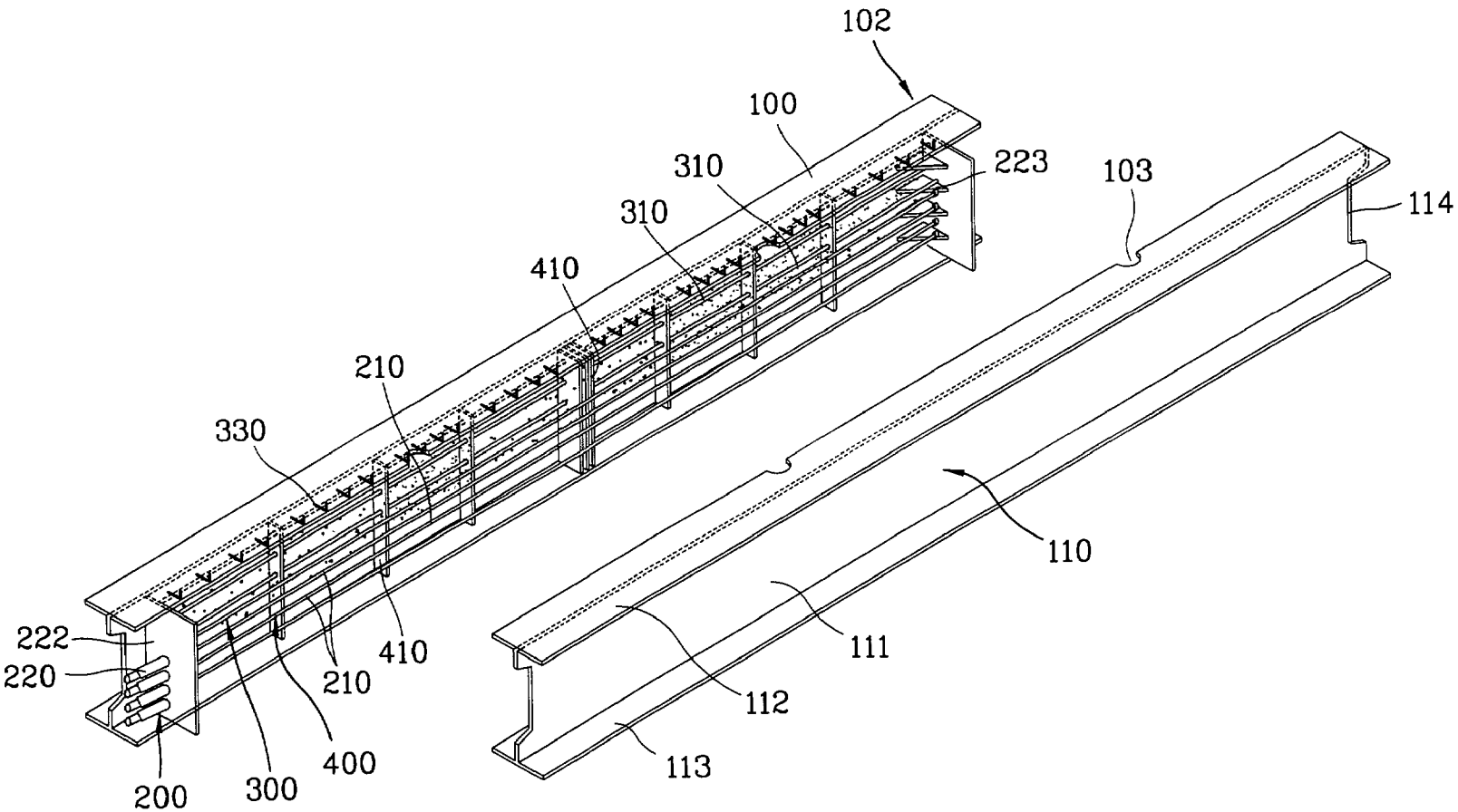
Figure 7:
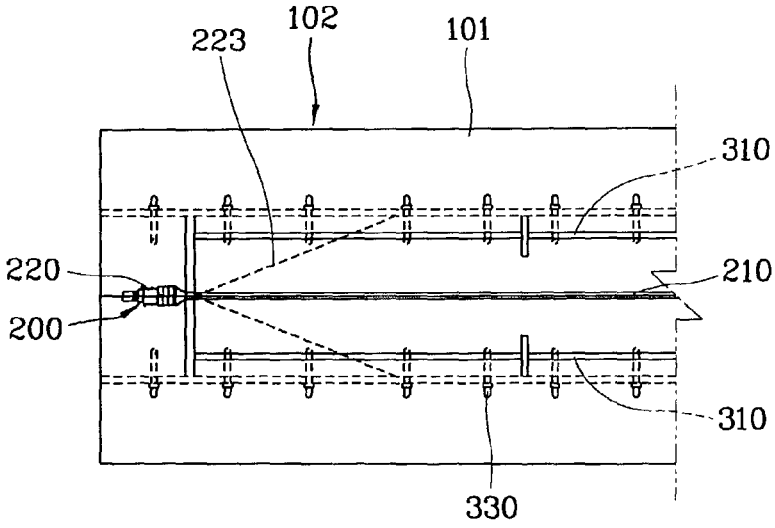
Figure 8:
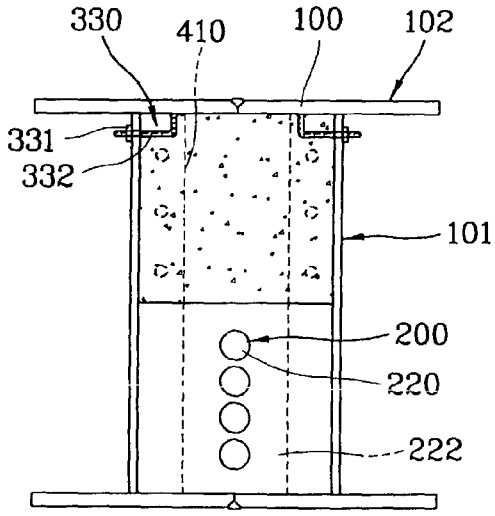
Figure 9A:
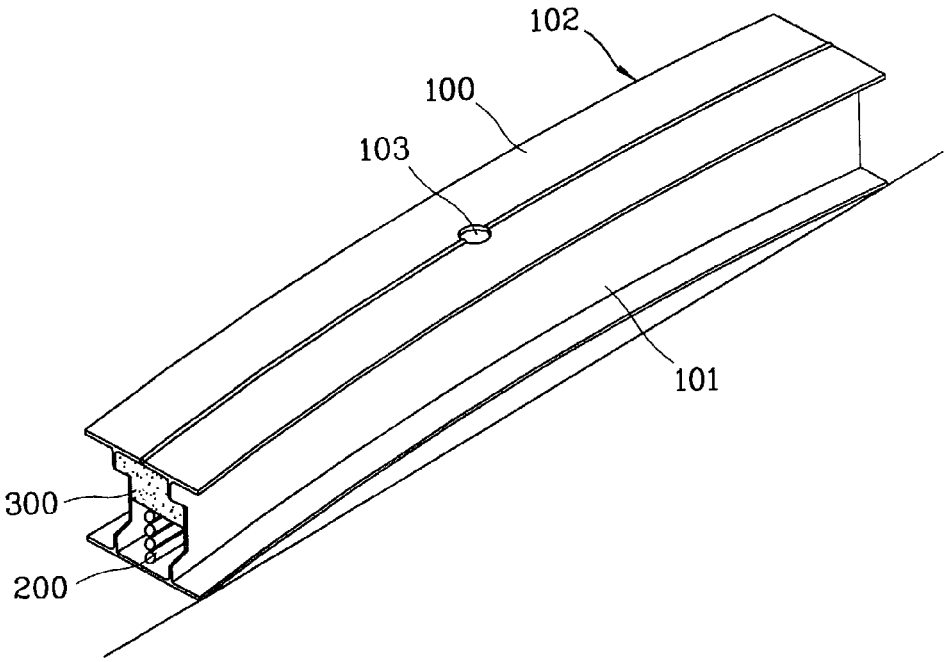
Figure 9B:
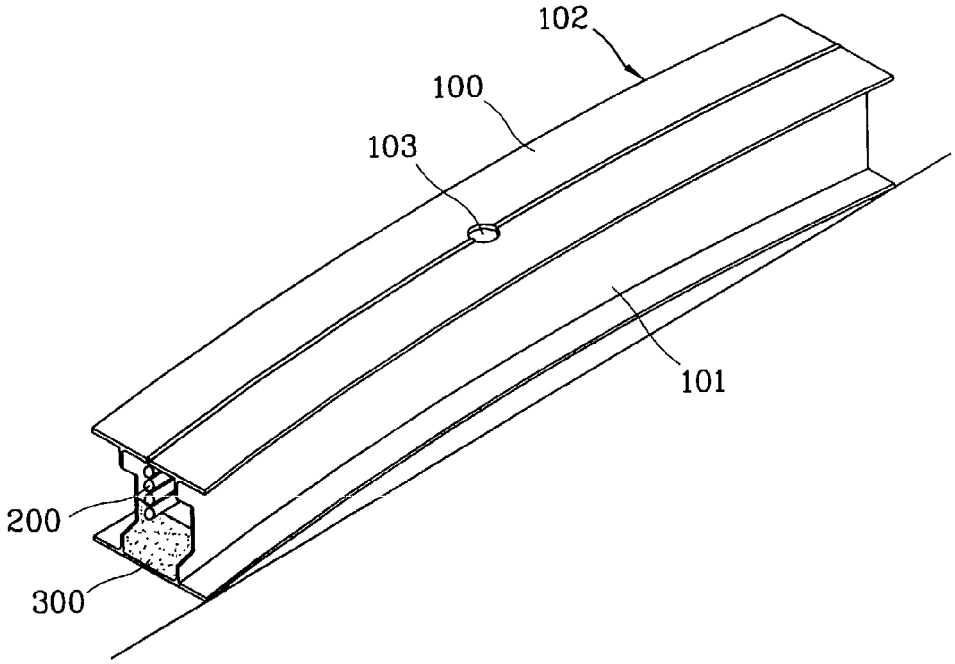

FIGS. 6 to 9 show a complex girder in accordance with the second embodiment of the present invention. The same reference numerals indicate same elements as in the first embodiment. FIG. 6 is an exploded perspective view showing the complex girder. FIG. 7 is a partial plan view showing the complex girder. FIG. 8 is a partially-sectional perspective view showing the complex girder. FIGS. 9*a* and 9*b* are partially-sectional perspective views showing a pre-stressed cambered shape of the complex girder.

In the PSSC complex girder of the second embodiment of the present invention, each settlement fixing plate 222 is fixed to both end portions of the section shape steel assembly 101, and both end portions of the tensional member 210 are inserted through holes formed in a row in the middle of the settlement fixing plates 222 to extend outside of the section shape steel structure 102. The tensional member is fixed in the holes by the settlement member 220.

Accordingly, the tensional members 210 are fixed in two rows at both end portions of the section shape steel assembly 101. Inside both section shape steel 100, strengthening means 400 for preventing buckling are respectively disposed between the web portion 111 of the side member 110 and the upper and lower flanges 112 and 113. A plurality of sheer prevention members 330 is also disposed inside of respective webs 111. Steel reinforcements 310 are arranged in the inner space portion of both the section shape steel 100 and the concrete 300 is poured therein.

Figure 10:
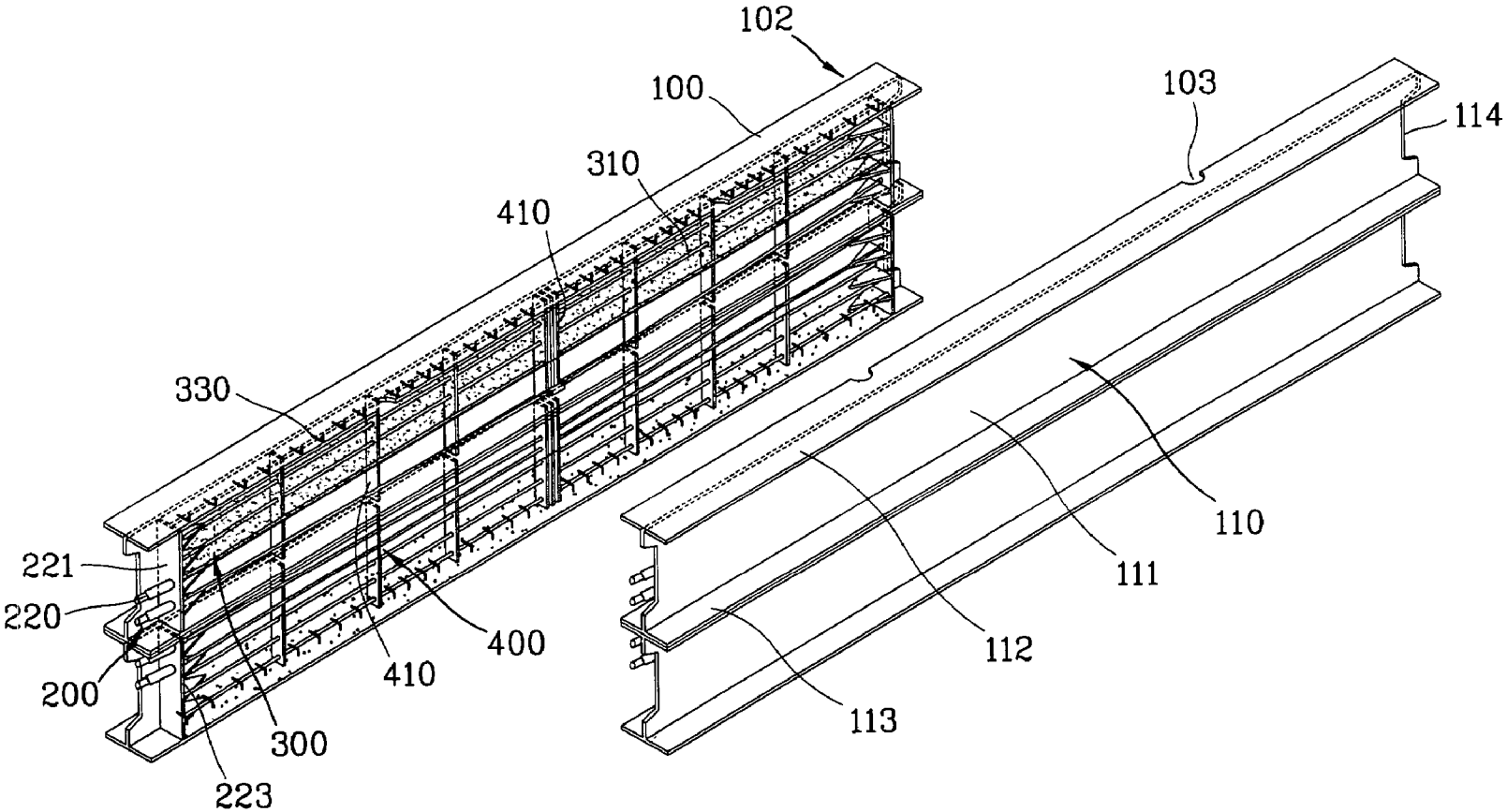
FIGS. 10 to 12 are unfolded perspective view, partially-sectional side view showing a complex girder in accordance with the third embodiment of the present invention and a partially-sectional perspective view showing cambered shape respectively.
Figure 11:
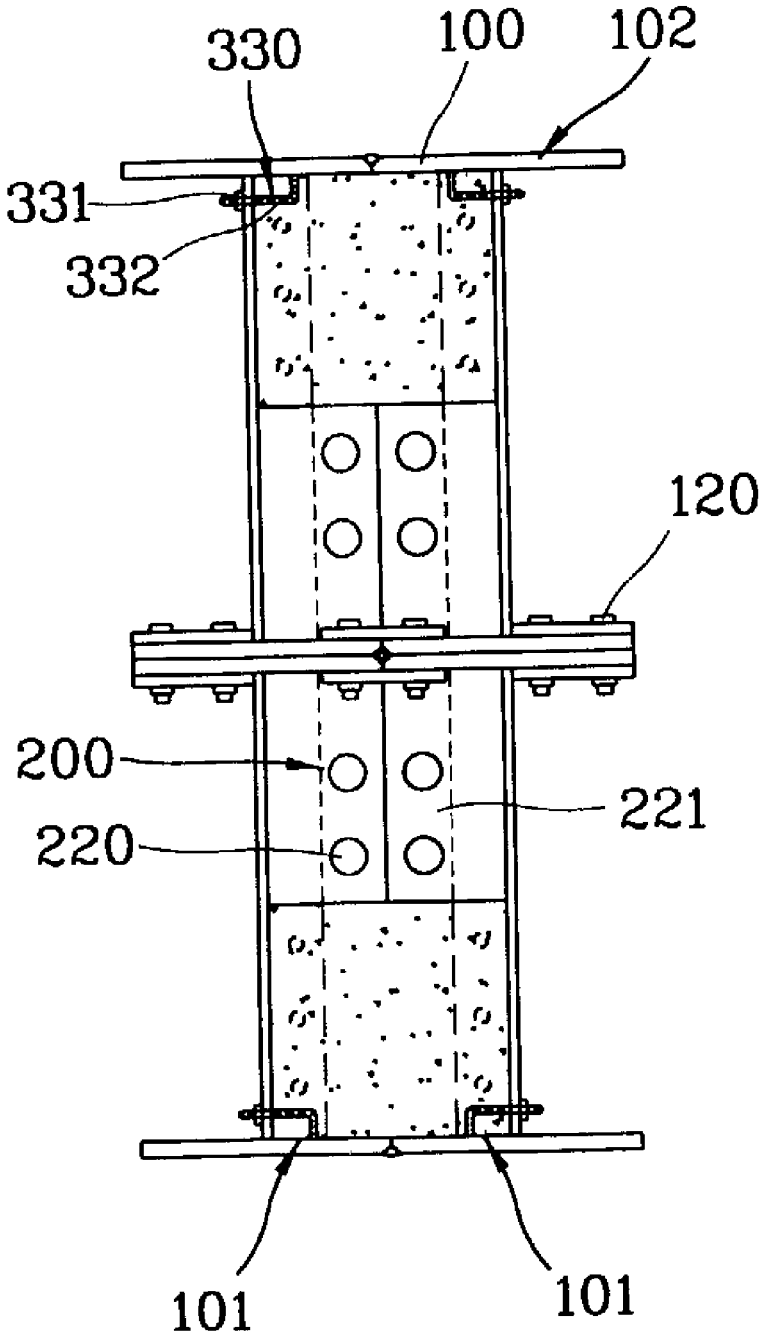
Figure 12:
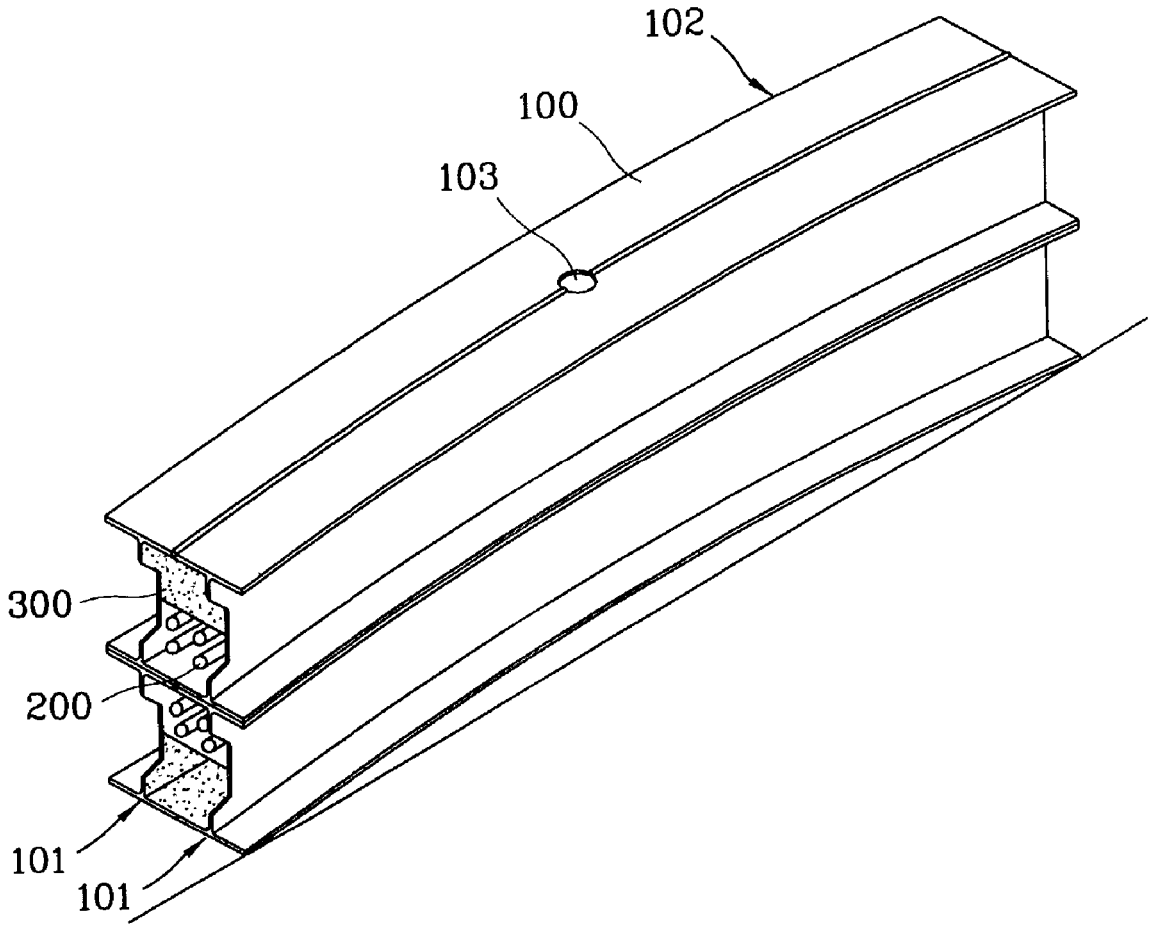

FIGS. 10 to 12 illustrate an exploded unfolded perspective view, partially-sectional side view showing a complex girder in accordance with the third embodiment of the present invention and a partially-sectional perspective view showing cambered shape, respectively.

As shown in the drawings, in the PSSC complex girder in accordance with the third embodiment of the present invention, the section shape steel 100 are vertically mounted and joined by a plurality of high-tensile bolt 120 fixed by nuts. As in the first embodiment of FIGS. 1 to 5, in the side members 110, the tension means 200 includes a tensional member 210 and settlement member 220 that are fixed in two rows to both end portions of the section shape steel assembly 101. In addition, the strengthening means 400 and concrete 300 are connected to both end portions of the section shape steel assembly 101.

Figure 13:
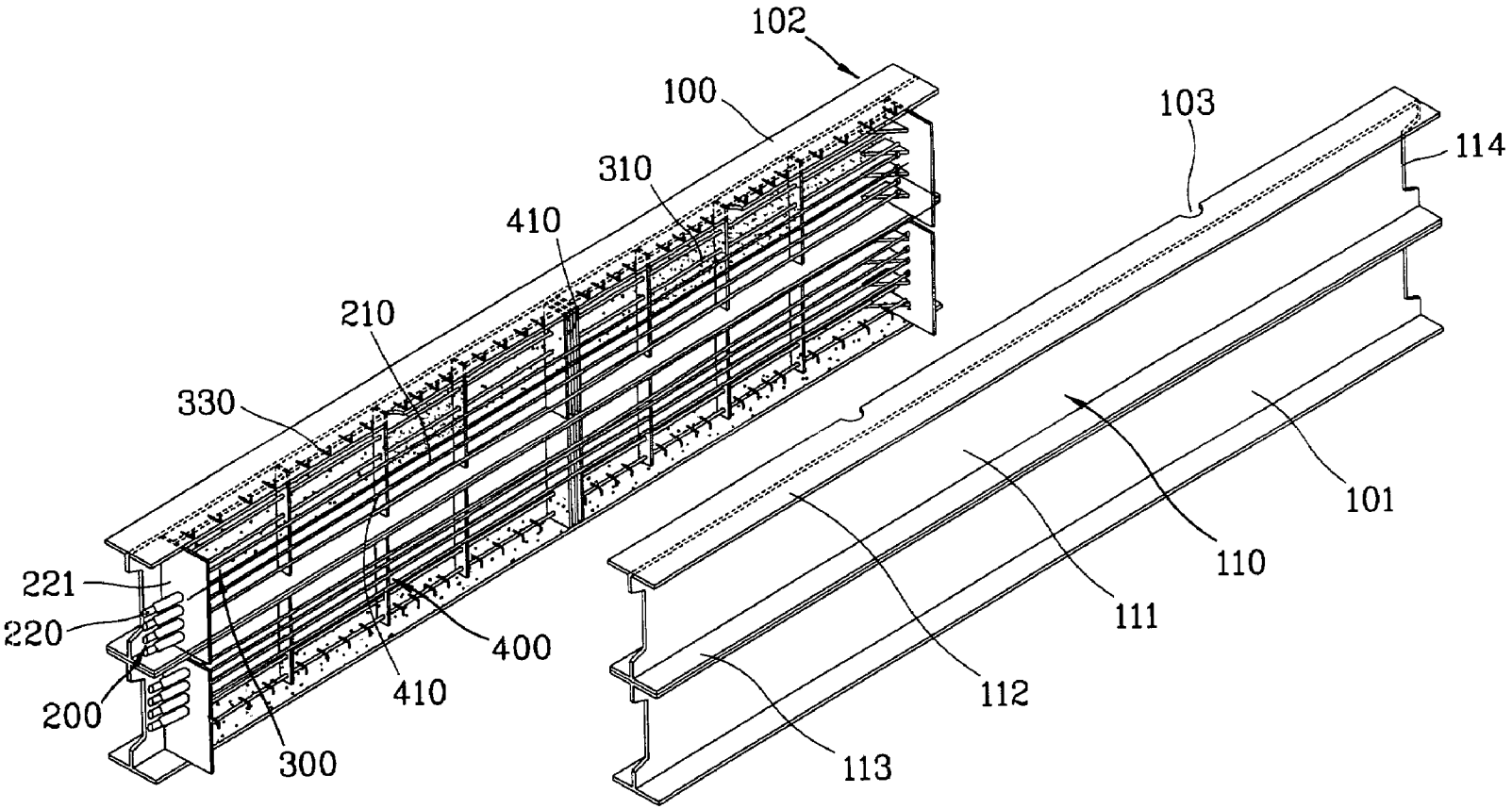
FIGS. 13 to 15 are unfolded perspective view, partially-sectional side view showing a complex girder in accordance with the fourth embodiment of the present invention and a partially-sectional perspective view showing cambered shape respectively.
Figure 14:
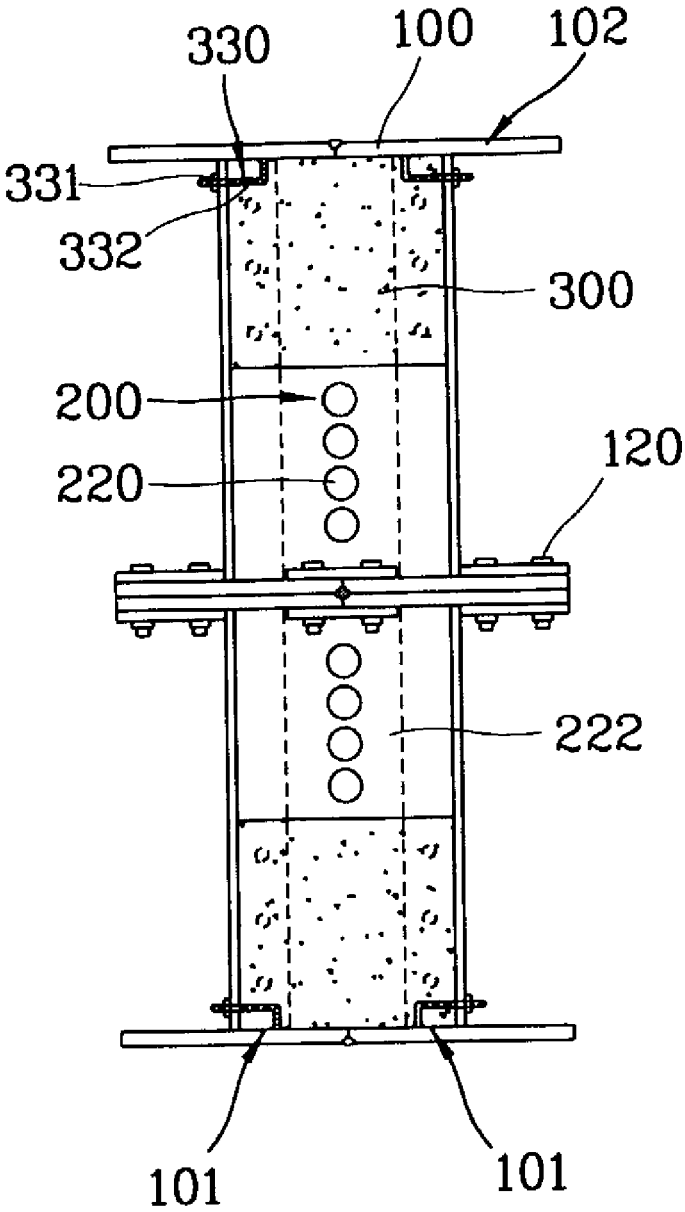
Figure 15:
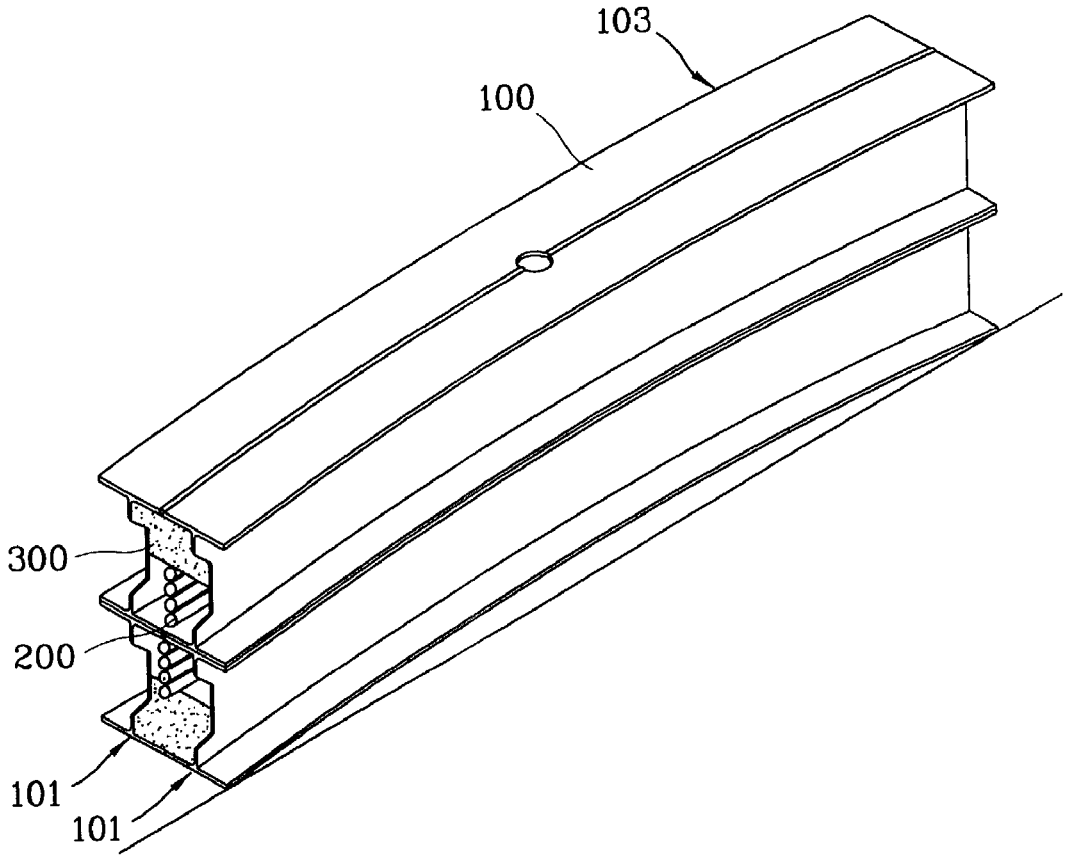

FIGS. 13 to 15 illustrate an exploded perspective view, a partially-sectional side view showing a complex girder and a partially-sectional perspective view showing cambered shape, respectively, in accordance with the fourth embodiment of the present invention.

In the PSSC complex girder in accordance with the fourth embodiment of the present invention, the section shape steel 100 are vertically mounted and joined by bolt connections 120. As in the second embodiment of FIGS. 6 to 9, in the side members 110, the tension means 200 includes a tensional member 210 and settlement member 220 that are fixed in two rows to both end portions of the section shape steel assembly 101. In addition, the strengthening means 400 and concrete 300 are disposed in both end portions of the section shape steel assembly 101.

As described above, the PSSC complex girder in accordance with the present invention can be used, for example, to construct a new bridge or repair a conventional bridge. The present invention can have a camber by tensioning the tensional member 210 at both end portions of the section shape steel structure 102. Therefore, deflection can be decreased and cracks can be prevented as the lower flange receives tensile stress. Also, a strengthening plate 410 for supporting buckling and compression is connected to the section shape steel 100. In addition, the sheer prevention member 330 and steel reinforcements 310 are connected to the section shape steel 100 and concrete 300 is poured therein. Accordingly, the section shape steel 100 and concrete 300 are unified, stiffness and strength are improved, and re-tensioning can be performed. As a result maintenance is easier and the span of the section shape steel structure is substantially increased. Also, a vibration range of the PSSC complex girder can be decreased to a large degree, since sectional moment of inertia can be increased by having the concrete inside the steel section shape steel 100.

In accordance with the present invention, the length, width, height, shape, and number of the tension means and shape of arrangement of the PSSC complex girder can be varied.

The PSSC complex girder in accordance with the present invention can achieve all advantages of both the PSC girder and the steel girder. Since the camber of the PSSC girder can be adjusted for new bridges and conventional bridges, either before or after construction, deflection of the slab can be easily decreased and cracks caused by flexural deformation can be prevented.

The strengthening plate for supporting buckling and compression is mounted inside the section shape steel. In addition, the sheer prevention member and steel reinforcement are joined to the section shape steel and concrete is poured into the section shape steel. Accordingly, the section shape steel and concrete are unified, stiffness and strength are improved, and re-tensioning can be performed. As a result, maintenance is easier and the span of the section shape steel structure is substantially increased. Also, a vibration range of the section shape steel structure can be decreased to a large degree, since sectional moment of inertia can be increased by having the concrete inside the section shape steel.

The tensional member is positioned inside the section shape steel structure and is not exposed. Therefore, an excellent appearance and long space under a bridge can be obtained. Also, a reduction in strength over time can be minimized, since the tensional member is installed in concrete.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A prestressed steel and concrete complex girder comprising:

a section shape steel structure formed of a combination of one or more section shape steel, a tension means for tensioning the section shape steel structure including a tensional member configured to provide the structure with a predetermined camber, and concrete disposed in an inner space portion of the section shape steel structure, wherein the section shape steel structure is formed as a box type section shape steel assembly which includes a plurality of section shape steel welded together at sides thereof; and wherein in the tension means, settlement fixing plates are respectively fixed to both end portions of each section shape steel which forms the section shape steel structure, both the end portions of the tensional member extending through holes in the settlement fixing plates to the outside of the section shape steel structure, the holes being on both settlement fixing plates; and wherein between the respective fixing plates, steel strengthening plates for preventing buckling among a web and upper and lower flanges are respectively joined to the web and a plurality of sheer prevention members are connected to the inside of the web, and steel reinforcement is arranged in the inner space portion of the section shape steel through the concrete.

* * * * *